United States Patent [19]

Gotz

[11] Patent Number: 4,861,121

[45] Date of Patent: Aug. 29, 1989

[54] SPACE EFFICIENT CABINET FOR HOUSING A COMPUTER WORK STATION

[75] Inventor: Lasar Gotz, Don Mills, Canada

[73] Assignee: Lam-Wood Products Inc., Rexdale, Canada

[21] Appl. No.: 103,337

[22] Filed: Oct. 1, 1987

[51] Int. Cl.[4] ..... A47B 21/00

[52] U.S. Cl. ..... 312/208; 312/7.2; 312/22; 312/324

[58] Field of Search ..... 312/330 R, 208, 7.2, 312/324, 22, 23, 24, 26, 27, 30, 233, 313, 328

[56] References Cited

U.S. PATENT DOCUMENTS

| | | | |
|---|---|---|---|
| 2,999,583 | 9/1961 | Mancini | 312/330 R X |
| 3,086,630 | 4/1963 | Wolf | 312/324 X |
| 3,176,118 | 3/1965 | Scott | 312/330 R X |
| 4,036,541 | 7/1977 | Kantor | 312/138 R |
| 4,428,631 | 1/1984 | Cope et al. | 312/208 X |
| 4,640,199 | 2/1987 | Zigman | 312/208 X |
| 4,669,789 | 6/1987 | Pemberton | 312/208 X |
| 4,669,790 | 6/1987 | Briggs | 312/208 |
| 4,681,378 | 7/1987 | Hellman, III | 312/208 X |
| 4,695,104 | 9/1987 | Lederman | 312/324 X |
| 4,696,522 | 9/1987 | Lowe | 312/208 X |

FOREIGN PATENT DOCUMENTS

| | | | |
|---|---|---|---|
| 2566223 | 12/1985 | France | 312/208 |
| 2567378 | 1/1986 | France | 312/208 |
| 8601086 | 2/1986 | PCT Int'l Appl. | 312/208 |

*Primary Examiner*—Peter A. Aschenbrenner
*Assistant Examiner*—Thomas A. Rendos
*Attorney, Agent, or Firm*—Rogers, Bereskin & Parr

[57] ABSTRACT

This invention relates to a space-efficient cabinet for housing a computer work station. The computer work station can include a video display monitor, a CPU/-disk-drive and a key pad. The cabinet has two generally opposed side walls and generally opposed front and back walls, which extend between the side walls. At least one horizontal surface is provided extending between said front back and opposed side walls, to carry the video display monitor. An inner angled shelf is also present, and is affixed between the side walls, to carry the CPU/disk-drive. The shelf is angled downwardly from front to back relative to the horizontal allowing access to the CPU/disk-drive whereby discs can be readily inserted into or removed from said CPU/disk-drive. The angle of this shelf carrying the CPU/disk-drive ensures a minimal footprint of the cabinet on the floor thus saving floor space. A moveable partition is also provided to support the key pad thereon.

7 Claims, 4 Drawing Sheets

SPACE EFFICIENT CABINET FOR HOUSING A COMPUTER WORK STATION

BACKGROUND OF THE INVENTION

1. Field of the Invention

This invention relates in general to a cabinet used to house a computer work station. In particular, this invention relates to a space-efficient cabinet for housing a computer work station that includes a CPU/disk-drive, a key pad and a video display monitor.

2. Description of the Prior Art

The advent of computers as an integral element of modern day society has meant that many people are using a computer on a fairly regular basis, either at home as a hobby, or at work, where the computer is used as a business tool. Currently, such computers consist of a number of discrete elements which make up a work station, and which typically include a video display monitor, a CPU/disk-drive cabinet, (also referred to herein as a computer, which typically has a disk drive located at one end, and also usually houses the central processing unit (or CPU), and a key pad.

Many attempts have been made to design an efficient desk or cabinet to house the computer work station. In most such prior attempts, the video display monitor is mounted on top of the CPU/disk-drive cabinet, which in turn is mounted upon a horizontal shelf surface, such as a desk top. Typically, the depth of the CPU/disk-drive cabinet, together with the space required for the electrical plugs at the rear of the cabinet, is such that there is little room left in front of the cabinet on conventional desks. Consequently, a lower outwardly extending shelf is sometimes provided, to support the key pad.

However, the foregoing arrangement is inefficient, and awkward to use. Typically a 24" deep horizontal surface is required for the CPU/disk-drive cabinet itself, with the key pad shelf being an even further extension. Further, the lack of work space in front of the cabinet means that when the computer work station is used for word processing or data entry, the operator must place the material being typed to one side, which requires a constant shifting from side to side between the screen and the material being typed. This causes an awkward straining of the operator's neck muscles. Also, work stations in which the elements are exposed often must be covered by dust covers, which are generally unattractive. Further, overhead fluorescent lighting can often cause a glare on the video screen which promotes eyestrain and operator error.

SUMMARY OF THE INVENTION

Therefore, it is an object of the present invention to provide a neat space-efficient cabinet for housing a computer work station which renders the computer easy and comfortable to use. Accordingly, in one of its aspects the present invention provides a space-efficient cabinet for housing a computer work station having a CPU/disk-drive and a video display monitor, said cabinet comprising two generally opposed side walls, generally opposed front and back walls extending between said side walls, at least one horizontal surface extending between said front, back and side walls for supporting, said video display monitor, and an inner angled shelf affixed between said side walls and located between said front and said back walls, said shelf being adapted to carry said CPU/disk-drive thereon, and said shelf being angled downwardly from front to back relative to the horizontal, allowing access to said CPU/disk-drive whereby disks can be readily inserted into or removed from said CPU/disk-drive.

DETAILED DESCRIPTION OF THE PREFERRED EMBODIMENT

Figure 1:
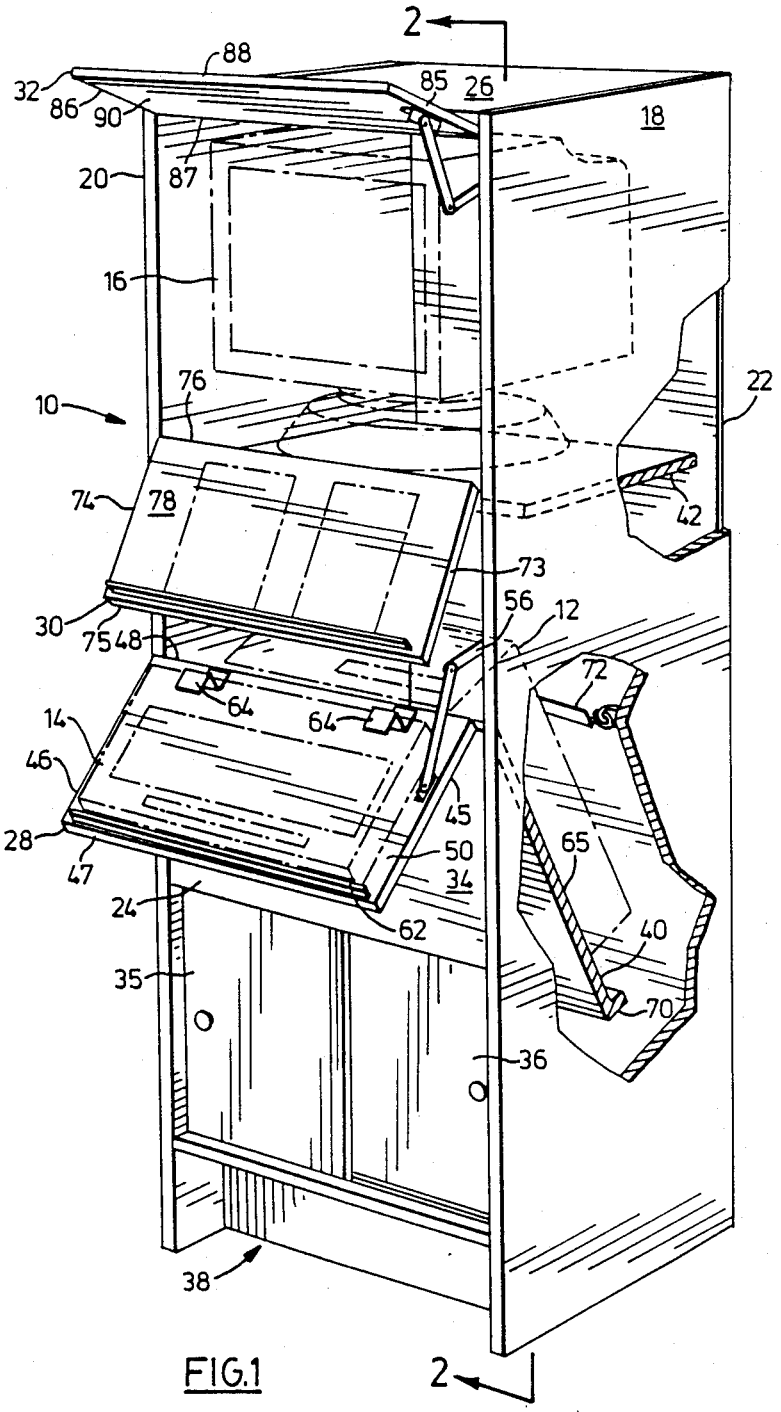
FIG. 1 is an isometric view from in front and to one side showing a space-efficient cabinet according to the present invention in an opened position.

Referring now to FIG. 1 is shown a space-efficient cabinet, indicated generally at 10, for housing a computer work station which consists generally of a CPU/-disk-drive cabinet 12, a key pad 14 and a video display monitor 16, which are shown in ghost outlines.

Figure 2:
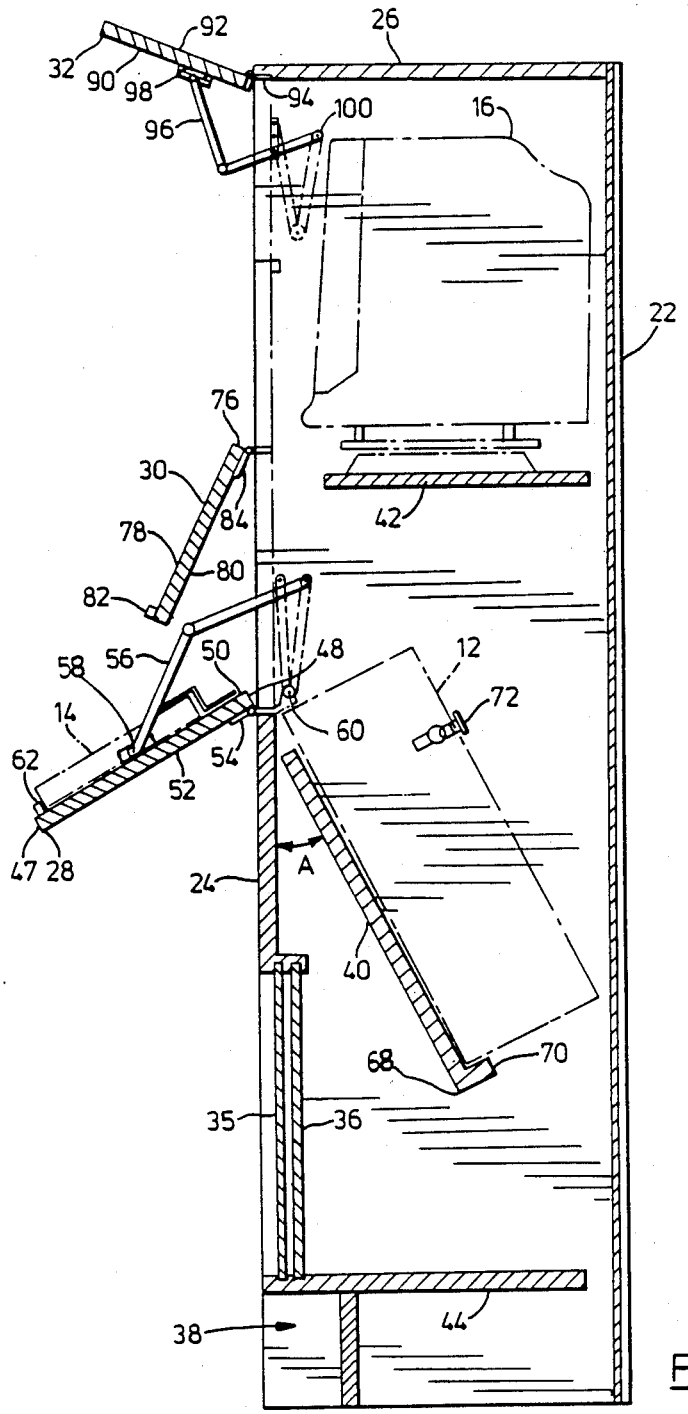
FIG. 2 is a side view along lines 2—2 of FIG. 1 showing the internal configuration of the invention of FIG. 1.

The cabinet 10 is comprised of opposed side walls 18, 20, a back wall 22, a front wall 24 extending between side walls 18, 20, and a top 26. The top 26 extends between the side wall 18, 20, the back wall 22 and the front wall 24. The front wall 24 is comprised of a number of sections including first moveable partition 28, second movable partition 30 and third moveable partition 32 (which are more fully explained below). Completing the front wall 24 are an immovable partition 34, sliding doors 35, 36, and a toe space 38. Completing the inside of cabinet 10, as best seen in FIG. 2, is an inner angled shelf 40, an upper shelf 42 and lower shelf 44.

Figure 3:
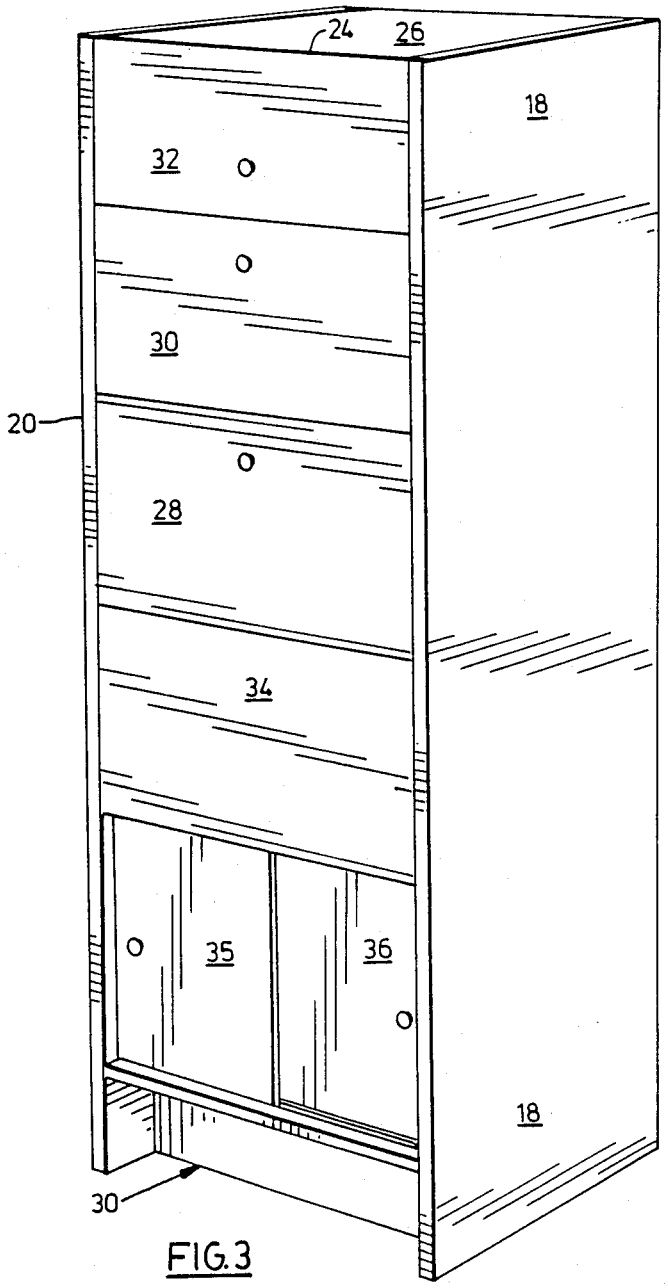
FIG. 3 is an isometric view similar to FIG. 1 showing a space-efficient cabinet according to the present invention in a closed position.

Referring back to FIG. 1, the first moveable partition 28 has opposed side edges 45, 46, opposed top and bottom edges 47, 48 and an inner surface 50 and an outer surface 52. The first moveable partition 28 is hingedly attached along its bottom edge 48, by hinges 54. In this manner, the first moveable partition 28 pivots about its bottom edge 48, between an open position and a closed position (FIG. 3). When the first moveable partition 28 is in its closed position, with inner surface 50 facing inside the cabinet 10, and the outer surface 52 being fully exposed, the outer surface 52 is flush with the immoveable partition 34.

In order to control the rotation of the first moveable partition 28 about hinges 54, a second hinge 56 is provided. The second hinge 56 has one end 58 attached to the inner surface 50 of the first moveable partition 28, and the other end 60 attached inside of side wall 18. The second hinge 56 is adjustable, and may be locked in any desired position, thereby locking the first moveable partition 28 at any desired angle.

The inner surface 50 of the first moveable partition 28 is adapted to carry the key pad 14. As shown in FIG. 1, the inner surface 50 has a projecting lip 62 running adjacent the top edge 47. Adjacent the bottom edge 48 are located two clips 64. The clips 64 are designed to flexibly and releasably secure a rear edge of key pad 14 as shown. The distance between the projecting lip 72 and the clips 64 is such that a conventional key pad, such as produced by IBM (a trademark of International Business Machines Inc.) for its personal computers, will be readily secured therebetween.

Closely adjacent the bottom edge 48 of the first moveable partition 28, is located the upper edge of inner angled shelf 40. The inner angled shelf 40 also has side edges 65, 66 (not shown) which are affixed to side walls 18 and 20 respectively, by gluing, screwing, doweling or the like. Along a bottom edge 68 of the inner angled shelf 40 is a projecting lip 70. As shown in FIG. 2, lip 70 supports the CPU/disk-drive cabinet 12 in position. An elastic strap 72 may also be secured between side walls 18, 20 to further secure the CPU/disk-drive cabinet on inner angled shelf 40.

Turning to FIG. 2, reference is now made to the angle A between the vertical, as represented by the front wall 24, an inner angled shelf 40. When the angle A is 90°, the inner angled shalf 40 will be horizontal. When A is 0°, the inner angled shelf 40 will be vertical. At any angle of A between 90° and 0,°, the inner angle shelf 40 will be sloped inwardly and downwardly. To achieve good utilization of the inside space of cabinet 10, it has been found that angle A should be between 20° and 45°. In this range the inner angled shelf 40 has a relatively short horizontal component, thereby allowing the side walls 18, 20 of the cabinet 10 to be correspondingly short, and yet allows for open space inside the cabinet 10 below the inner angled shelf 40 as described herein. It will be appreciated that by having the side walls 18, 20 short in the manner described means the cabinet 10 occupies a minimum of floor space. In modern offices, where floor space is at a premium, such a space-efficient design is highly desirable.

As shown in FIGS. 1 and 2, the second moveable partition 30 is similar in shape and operation to the first moveable partition 28. The second movable partition 30 also has opposed side edges 73, 74, opposed top and bottom edges 75, 76, and an inner surface 78 and an outer surface 80. As with the first movable partition 28, the references to top, bottom, inner and outer relate to the partition 30 in its closed position (FIG. 3). When the second moveable partition 30 is in the closed position, the outer surface is flush with immovable partition 34, and the first movable partition 28 in the closed position.

As shown in FIG. 2, second moveable partition 30 has a projecting lip 82. In the open position, projecting lip 82 will retain papers thereon which greatly facilitates data entry or word processing. The second moveable partition 30 is hingedly attached along its bottom edge 76 by hinges 84. In this manner, the partition 30 pivots about its edge between open and closed positions in a like manner to first moveable partition 28. However, the angle of the open position is not adjustable, with the second moveable partition 30 merely stoppig against its hinges 84 at a predetermined angle.

The third moveable partition 32, again operates in much the same manner as the partitions 28 and 30 previously described. The third moveable partition 32 also has opposed side edges 85, 86, opposed top and bottom edges 87, 88 and an inner face 90 and outer face 92. The third moveable partition 32 is hingedly attached along its top edge 87, by hinges 94. In this manner, the third moveable partition 32 pivots about its top edge 87 between a closed position (FIG. 3) and an open position (FIG. 1). When the third moveable partition 32 is in its closed position, with the inner face 90 facing into the interior of cabinet 10 and the outer face 92 exposed, the outer surface 92 is flush with the immoveable partition 34, and with the partitions 28 and 30 in their closed positions.

To control the rotation of the third moveable partition 32, about the hinges 94, a second hinge 96 is provided. The second hinge 96 has one end 98 secured to the inner face 90 of third moveable partition 32, and the other end 100 attached to the inside of the side wall 18. The second hinge 96 is adjustable and may be locked in any desired position, thereby locking third moveable partition 32 at any desired angle.

The upper shelf 42 is located adjacent the bottom edge 76 of second moveable partition 30. The upper shelf 42 extends between the side walls 18, 20 and is secured thereto by screws, gluing, dowels or the like fasteners. However, the upper shelf 42 does not extend the full depth of the side walls 18, 20. Rather, it is somewhat shorter, to allow a space at the rear for electrical cables and the like. The second and third partitions 30, 32 and the shelf 42 are all dimensioned to comfortably house a conventional video display monitor 16 on the shelf 42 so that when the partitions 30, 32 are opened, the monitor 16 is in full view as shown in FIGS. 1 and 2.

The lower shelf 44 is located behind sliding doors 35, 36. The lower shelf 44 extends between the side walls 18, 20 and from the front wall 24 to the back wall 22. It is secured in place in a like mannèr as shelves 40 and 42. The lower shelf 44 is intended to be storage space for placement of computer related components, such as a modem for telephone communications or storage of other materials, which is easily accessible through sliding doors 35, 36. It will now be appreciated that when the angle A of inner angled shelf 40 is between 20° and 45°, the space on top of shelf 44 is maximized. Beneath shelf 44 is provided the toe space 38, which allows the computer operator to sit comfortably close to the cabinet 10.

It will now be appreciated that the cabinet 10, when all of the movable partitions 28, 30 and 32 are closed, presents an attractive exterior, resembling a piece of furniture, that could find its place in homes or offices. However, the cabinet 10, can efficiently, in terms of space, house a conventional computer work station that includes a video display monitor 16, a key pad 14 and a CPU/disk-drive and CPU cabinet 12. The angling of the inner angled shelf 40 has the dual function of reducing the overall depth of the cabinet 10, along side walls 18, 20 and also maximizing the space above lower shelf 44. The key pad 14 is secured to the partition 28, the angle of which can be adjusted to suit the individual operator. By opening the first moveable partition 28, both the key pad, and the CPU/disk-drive cabinet are exposed for use.

The video display monitor 16 is conveniently housed directly above the key pad 14. The second moveable partition 30, in the open position, forms a convenient document holder, again directly above the key pad 14. In this manner, the computer operator does not have to crane his or her neck to glance at the screen from the key pad 14 or document holder (moveable partition 30). Finally, the third moveable partition 32 forms an adjustable shade to prevent glare of an overhead lighting system from detrimentally affecting the visibility of the video display monitor 16. The shade effect will be most important in office settings, which typically may be lit by overhead fluorescent light systems.

Figure 4:
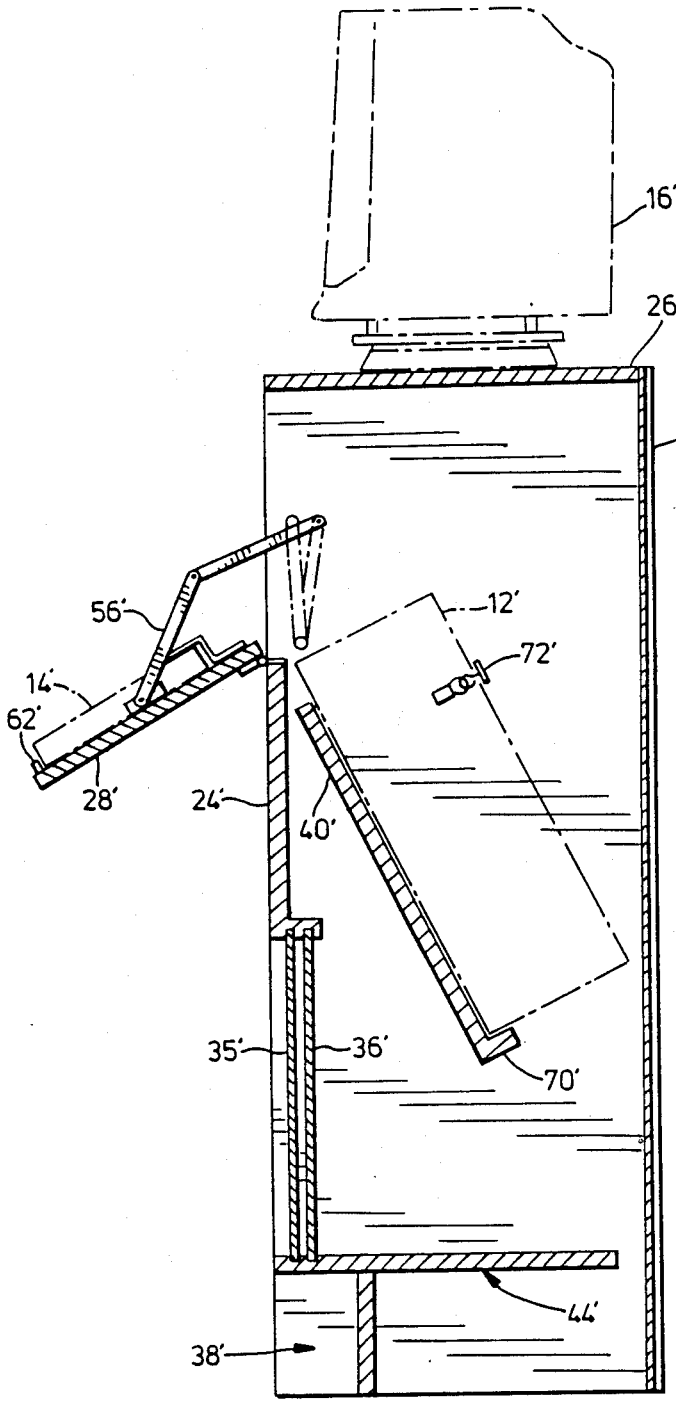
FIG. 4 is a side view of a second embodiment of the present invention.

Turning now to FIG. 4, a second embodiment of the present invention is shown. In this second embodiment, like numerals, with a prime, indicate like components in the first embodiment. As shown, in the second embodiment, there is no second or third moveable partition 30 or 32. Also, rather than resting inside of cabinet 10', the video display monitor 16' sits on the top 26'. In this embodiment, the top 26' doubles an an upper shelf and may be used for storage of computer related material. Shelf 26' could also be shorter than the side walls 18', and 20' if desired to allow an electrical connection between the video display monitor 16' and the CPU/disk drive cabinet 12'. However, in all other respects, the second embodiment is the same as the first embodiment.

With respect to both embodiments, the preferred construction material is wood, or plastic laminated wood products. It will be appreciated by those skilled in the art that the construction can be secure, such as by screwing, gluing or doweling, or can be of the knock-down type, where the joints may be readily assembled or removed. The knock-down assembly is preferred for certain home and office installations, and can be used to reduce manufacturing costs.

I claim:

1. A space efficient cabinet for housing a computer work station having at least a computer, a video display monitor and keyboard, said cabinet comprising:

two generally opposed upstanding side walls, opposed front and back walls positioned at right angles to said side walls, and a horizontal top, said front wall comprising a plurality of hingeable partitions, each having at least an open position and a closed position and being moveable therebetween, said partitions comprising a first rectangular partition adopted to carry said keyboard on an inner face, said first partition having opposed top and bottom edges and opposed side edges, said top and bottom edges being at least slightly longer than the length of said keyboard, said side edges being at least slightly longer than the width of said keyboard, a second rectangular partition having a pair of opposed side edges and opposed top and bottom edges and being adapted to carry documentary material on an inner face; and a third rectangular partition having a pair of opposed side edges and opposed top and bottom edges, the sum of the length to one side edge of said second partition plus the length of one side edge of said third partition being slightly greater than the height of said video display monitor, said cabinet further including at least one horizontal shelf running between said side walls for supporting said video display monitor behind said second and third partitions when said second and third partitions are in the closed position, and at least one angled shelf, running between said side walls for carrying said computer, said angled shelf being angled downwardly from front to back relative to the horizontal, and having an upper edge located adjacent said first partition, said computer being accessible when said first partition is in the open position, said side walls of said cabinet being only sufficiently long from front to back to accommodate said video display monitor and any electrical connections thereto, said cabinet, when said partitions are all closed, occupying a minimum of floor space, and when said partitions are open, providing a computer work station wherein said first partition forms an extended keyboard support, said second partition forms an extended document holder and said third partition substantially shades said video display monitor from overhead glare.

2. A space-efficient cabinet as claimed in claim 1, further comprising a lower shelf affixed between said side walls and located under said innner angled shelf, and said inner angled shelf is angled between 20° and 45° to the vertical.

3. A space-efficient cabinet as claimed in claim 2 further including a toe space for the operator, said toe space being located at the bottom of said front wall.

4. A space-efficient cabinet as claimed in claim 1 further including at least one adjustable hinge, said first partition being releasably securable at any desired angle by said adjustable hinge.

5. A space-efficient cabinet as claimed in claim 1 wherein said inner angled shelf includes an upwardly projecting lip at the lower end thereof, and said cabinet includes resilient retaining means for securing said computer to said inner angled shelf.

6. A space-efficient cabinet as claimed in claim 5 wherein said resilient retaining means comprises an elastic strap secured to said side walls and stretched over said computer.

7. A space efficient cabinet as claimed in claim 1 wherein said first partition includes on an inner face a pair of resilient clips at said bottom edge and a projecting lip at said upper edge to retain said keypad therebetween.

* * * * *